United States Patent [19]

Gasparrini et al.

[11] Patent Number: 4,972,780

[45] Date of Patent: Nov. 27, 1990

[54] PRINTING PRESS BLANKET CLEANER

[75] Inventors: Charles R. Gasparrini, Rye, N.Y.; Carl Arnolds, Stamford, Conn.

[73] Assignee: Baldwin Technology Corp., Stamford, Conn.

[21] Appl. No.: 393,074

[22] Filed: Aug. 9, 1989

Related U.S. Application Data

[63] Continuation of Ser. No. 153,256, Feb. 8, 1988, abandoned.

[51] Int. Cl.[5] ..... B41F 35/06; B41L 41/06

[52] U.S. Cl. ..... 101/217; 15/308; 15/256.51; 101/425

[58] Field of Search ..... 101/217, 423, 425 X; 355/297, 301, 213; 15/301, 105, 256.5, 257.2, 308, 256.51

[56] References Cited

U.S. PATENT DOCUMENTS

| | | | |
|---|---|---|---|
| 504,465 | 9/1893 | Beater | 101/425 |
| 1,114,893 | 10/1914 | Lerche | 101/425 |
| 1,378,278 | 5/1921 | Roberts | 101/425 |
| 2,857,290 | 10/1958 | Bolton | 355/301 X |
| 3,049,997 | 8/1962 | Grembecki et al. | 101/425 |
| 3,309,993 | 3/1967 | Grembecki et al. | 101/425 |
| 3,835,779 | 9/1974 | Ross et al. | 101/423 |
| 4,015,307 | 4/1977 | Kossak | 101/425 X |
| 4,072,103 | 2/1978 | Fletcher et al. | 101/425 X |
| 4,134,673 | 1/1979 | Fisher | 355/301 |
| 4,298,268 | 11/1981 | Sato et al. | 355/301 X |
| 4,304,026 | 12/1981 | Borostyan | 355/297 X |
| 4,389,936 | 6/1983 | Jaffa et al. | 101/425 X |
| 4,400,083 | 8/1983 | Beisty et al. | 355/213 |
| 4,667,597 | 5/1987 | Wright et al. | 101/425 |

FOREIGN PATENT DOCUMENTS

| | | | |
|---|---|---|---|
| 243051 | 2/1912 | Fed. Rep. of Germany | 101/425 |
| 3601539 | 7/1986 | Fed. Rep. of Germany . | |
| 2117385 | 6/1972 | France . | |
| 55-55871 | 4/1980 | Japan . | |
| 54337 | 10/1910 | Switzerland | 101/425 |

OTHER PUBLICATIONS

Xerox Disc. Journal, "Guard at the Developer System to Protest Against Foreign Objects", Blochway, vol. 1, No. 6, Jun. 1976, p. 45.

IBM Tech. Disc. Bulletin, "Cleaner-to-Developer for Recirculation", Eide et al., vol. 21, No. 5, Oct. 1978, pp. 1784–1785.

Xerox Disc. Journal, "Blade Cleaner Scale for Magnetic Brush Cleaner", vol. 8, No. 4, Jul./Aug. 1983, pp. 359–360.

Xerox Disc. Journal, "Flexible Cleaner Seal", McCarroll, vol. 8, No. 5, Sep./Oct. 1983, p. 431.

*Primary Examiner*—Edgar S. Burr
*Assistant Examiner*—Moshe I. Cohen
*Attorney, Agent, or Firm*—Morgan & Finnegan

[57] ABSTRACT

A vacuum blanket cleaning system is provided for removing dust, lint or ink from a blanket cylinder in an offset printing press during the uninterrupted course of a press run. Operation is effected by an air cylinder which periodically urges a brush against the blanket cylinder and retracts the brush from the blanket cylinder for replacement or maintenance. The action of the brush in combination with rotation of the blanket cylinder is such as to loosen dust and lint from the blanket cylinder, which dust and lint is then drawn into a vacuum system that surrounds the brushes.

11 Claims, 3 Drawing Sheets

PRINTING PRESS BLANKET CLEANER

This is a continuation of co-pending application Ser. No. 07/153,256, filed on Feb. 8, 1988, abandoned.

BACKGROUND OF THE INVENTION

This invention relates to cleaning apparatus for printing presses and, in particular, to a dry vacuum apparatus for cleaning a blanket cylinder in an offset printing press without interrupting or slowing the operation of the press.

Offset printing, in comparison with the letterpress method of printing, has become the predominant printing method in the newspaper publishing industry. This is due in part to the increased sharpness of the printed images and the ability to print on less even surfaces than are required by the letterpress method. Also, another important factor in the popularity of offset printing is the lower cost of the printing plates used with offset presses.

Offset printing presses typically employ a blanket cylinder, that is to say, a rubber cylinder or a rubber-covered cylinder, for the purposes of receiving inked images from a printing plate. The inked images are then offset onto paper passed between the blanket cylinders or an impression cylinder. Continuous printing is made possible by wrapping a printing plate or a plurality of printing plates around the surface of a plate cylinder designed for rotation in contact with the blanket cylinder.

In operating blanket-to-blanket presses, a web of paper passes between two blanket cylinders mounted such that one blanket cylinder serves as an impression cylinder for the other, resulting in simultaneous printing on both sides of the web of paper.

Continuous offset printing is adversely affected by dust and lint from the web of paper which tend to accumulate on the blanket cylinder(s). This dust and lint reduces the quality Of the printed product. The accumulation of dust, lint or ink on a blanket cylinder thus presents a serious annoyance and necessitates undesirable down-time for cleaning. The problem is especially acute in the newspaper industry, when, in response to the rising cost of newsprint stock, less expensive grades of paper having higher lint content often are substituted for more expensive grades.

Previously known vacuum devices for cleaning blanket cylinders involved wet vacuum systems for removing debris. In these systems, segments of the blanket cylinder are continually immersed and cleaned with a solvent. The excess solvent is then removed by a wiper with a vacuum header adjacent the wiper blade. See, for example, U.S. Pat. No. 3,835,779 to Ross et al. The present invention avoids the need for solvents by employing a completely dry system for removing debris and, unlike previous dry systems, no lint catcher is needed or used.

OBJECTS AND STATEMENT OF THE INVENTION

It is, therefore, an object of the present invention to provide an apparatus for cleaning a blanket cylinder during the course of a press run without interrupting press operation or causing waste during the run. This permits a sharper reproduction for a printed product and incurs less down-time. It also permits the use of grades of paper stock having higher lint contents.

Another object of the present invention is to provide an apparatus suitable for integral construction with an offset press, or for manufacture as an add-on device capable of being retrofitted to an existing press.

A further object of this invention is to provide an improved vacuum blanket cleaner adapted for automatic operation at a frequency of engagement adjustable by a press operator.

Another object of this invention is to provide an improved vacuum blanket cleaner which will not abrade the blanket cylinder.

Another object of this invention is to provide an improved vacuum blanket cleaner which promotes longer blanket life.

Yet another object of this invention is to provide an improved vacuum blanket cleaner which may be operated without causing waste of materials.

Still another object of this invention is to provide an improved vacuum blanket cleaner which operates to provide a longer plate life.

In accordance with this invention, generally stated, an apparatus for cleaning a blanket cylinder of an offset printing press during operation of the press is provided, having a brush and a brush holder which are periodically urged against the blanket cylinder by the motion of a pivoting arm connecting the brush with an air cylinder. The action of the brush in combination with rotation of the blanket cylinder is such as to loosen dust and lint from the blanket cylinder. The dust and lint is then drawn into a vacuum system which includes a housing that surrounds the brushes. These brushes may also be segmented to allow portions of the brushes to be disengaged when not needed. Alternatively, where segmenting is not feasible, the brushes may be made laterally adjustable so that it aligns with webs of varying dimensions.

The frequency of the automatic engagement and operation of the blanket cleaner of this invention is adjustable by a press operator in response to various anticipated or observed operating parameters such as the length of the press run and the lint content of the paper stock. The invention further including means in the housing adapted to engage the blanket cylinder and serves the dual functional of loosening dirt and lint and sealing the vacuum system.

The foregoing and other objects, features and advantages of the present invention will be apparent to those skilled in the art in light of the following description of preferred embodiments in connection with the accompanying drawings.

DESCRIPTION OF PREFERRED EMBODIMENTS

Figure 1:
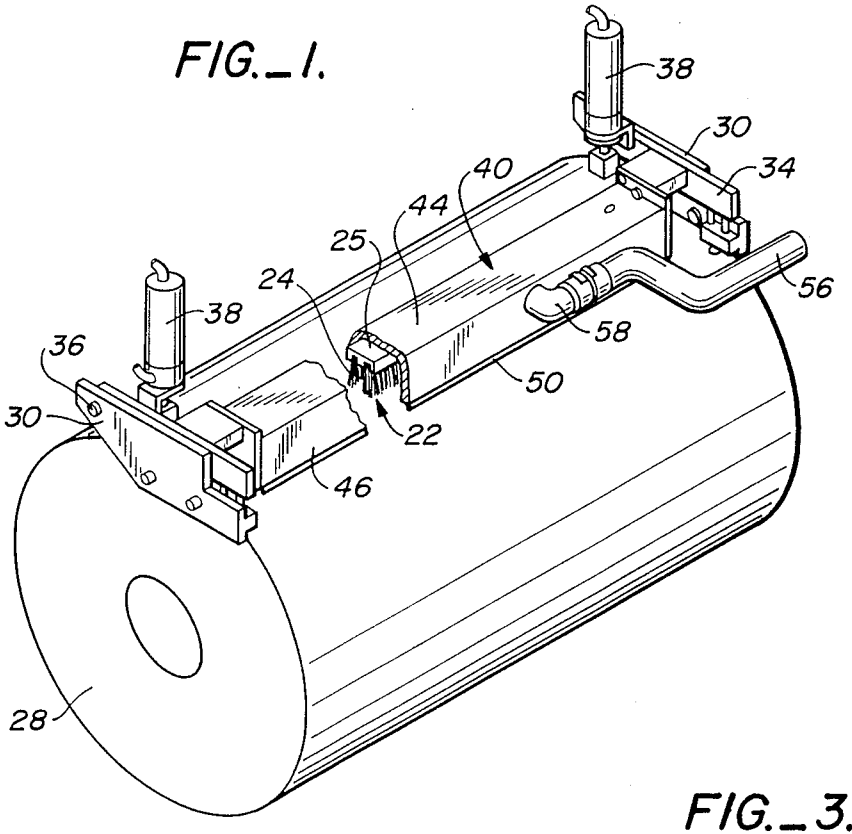
FIG. 1 is a side perspective view, in partial cross-section, of a vacuum blanket cleaner system constructed in accordance with one embodiment of the present invention.

Referring now to the drawings, and, in particular, to FIG. 1, there is shown a dry blanket cleaner in accordance with one embodiment of the present invention. The blanket cleaner, shown generally at 20, includes a brush assembly 22 made up of at least one brush 24 and a vacuum means (not shown).

The blanket cleaner in accordance with this embodiment of the present invention is mounted in operative association with a blanket cylinder 28, generally parallel to a longitudinal axis of the blanket cylinder. Blanket cleaner mounting brackets 30 are attached to the press frame (not shown) generally outside either end of blanket cylinder 28. Pivoting arms 34 connect the blanket cleaner 20 with mounting brackets 30. These pivoting arms 34 serve to carry the blanket cleaner 20 and are pivotal about pin 36.

The blanket cleaner is generally pivotal between two operative positions. Pivoting of said arms 34 between these positions is affected by a plurality of actuators 38 attached to pivot arms 34. Preferably, the actuator employed is a pneumatic actuator, although electrical or hydraulic actuators can be used if desired. Conventionally, compressed air is used because it is commonly is available in the press rooms, while electrical or fluid sources are not. In the first operative position, blanket cleaner 20 is biased away from blanket cylinder 28 to facilitate, for example, replacement of the brushes, repair or maintenance of the machine and/or changing of the web.

In the second operative position, the blanket cleaner 20 is held in contact with the surface of the blanket cylinder 28. In this second position, the blanket cleaner can affect cleaning and removal of the lint and debris from the blanket cylinder.

The vacuum portion of one embodiment of blanket cleaner 20 is generally comprised of substantially U-shaped housing 40 extending along the length of the blanket cylinder and a brush assembly 22. The brush assembly 22 is mounted inside housing 40 which in turn is mounted to pivot arms 34. The housing 40 includes brushes 24 retained in brush holder 25, which brush holder is removably mounted to the housing 40 in any convenient manner and can be easily replaced as required. Brushes 24 can be mounted in pairs as shown and have a relatively long life. However, continual operation will require replacement and maintenance of the brushes.

Figure 5:
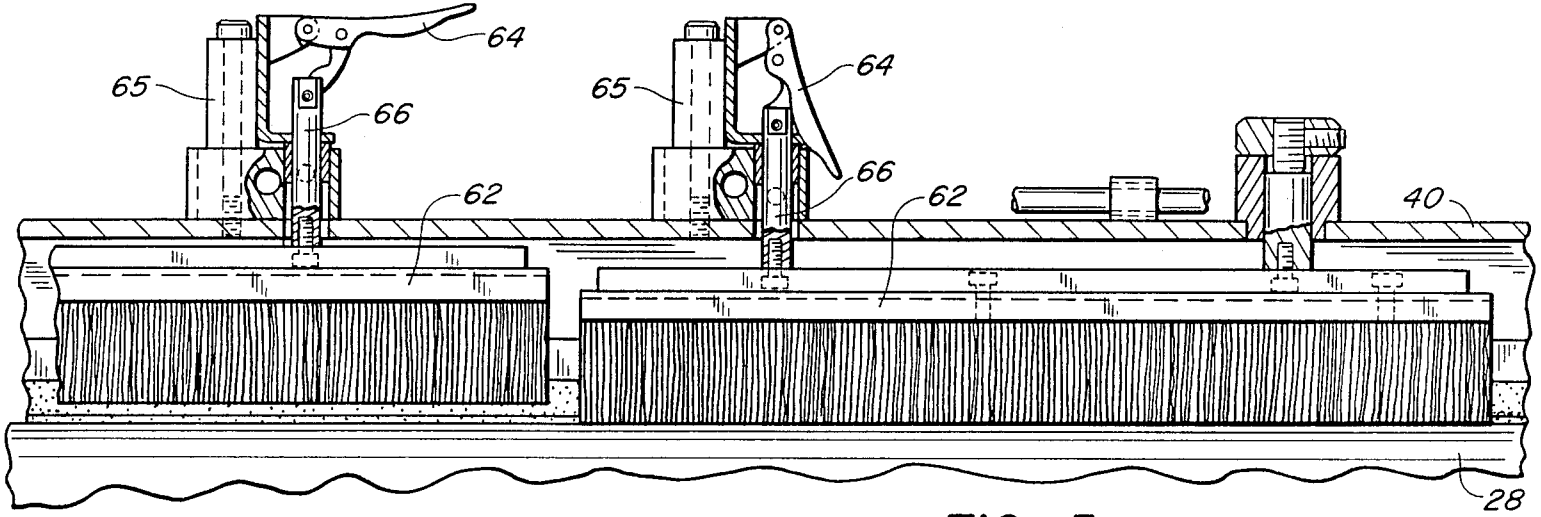
FIG. 5 is a front view in cross-section of a brush assembly having segmented brushes.
Figure 6:
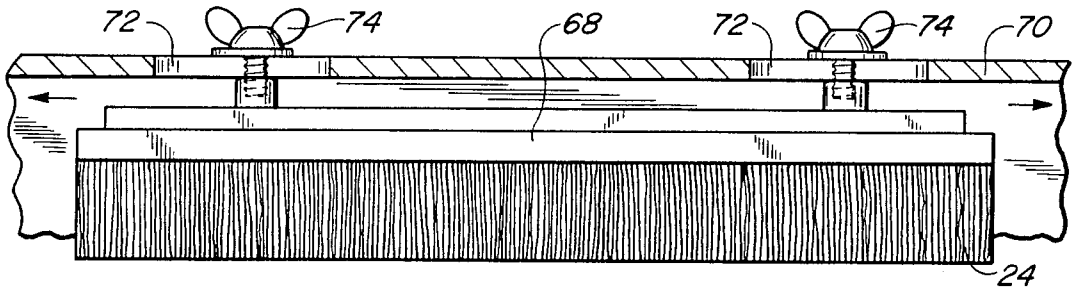
FIG. 6 is a front view in cross-section of a brush assembly having laterally adjustable brushes.

Referring now to FIGS. 5 and 6 there is shown two alternate embodiments for the brush assembly. In FIG. 5, brush holder 62 is segmented to allow individual sections to be lifted so as not to contact the blanket cylinder during cleaning. Segmenting can be desirable since newspaper blanket cylinders are generally set up in quarters or pages; i.e, a web can be double width (full blanket) or single width (half blanket). If a single width is used, ink can get onto the cylinder that does not have the web covering it. When that occurs, ink can foul the continuous brushes in the non-web area. Segmenting the brushes, preferably into four sections, permits the brushes in the unused area to be lifted away.

In the embodiment shown in FIG. 5, lifting is accomplished by manually moving lever 64 of lifting assembly 65 into the down position. This acts to lift guide rod 66 attached to brush holder 62 and bias that section of the brush holder away from the blanket cylinder. The brush assembly may be segmented into as many sections as desired to provide for maximum versatility. Generally, segmenting the brush assembly into four sections covers most operations. Also, lifting may be accomplished by any effective means and can be done either manually, as shown, or by automatic or semi-automatic means.

In the case of commercial web presses, segmenting of the brushes may not be feasible. This is because the web being operated on may vary greatly in width. For such applications the brush assembly can be made laterally adjustable along the width of the blanket cylinder. (See FIG. 6) In the embodiment shown in FIG. 6, brush holder 68 is slideably mounted within housing 70 along slots 72. Locking means 74 serve to maintain the brushes in the desired lateral location. In the embodiment shown in FIG. 6, wing nuts are used to lock the brushes in the desired location. In this fashion the brushes may be aligned for the particular application to be performed.

A variety of materials can be used for the brushes 24, provided that they do not damage the surface of the blanket cylinder 28. These materials include both natural and synthetic fibers. Also the brushes 24 can be mounted at an angle of up to 90° from the tangent to the surface of the blanket cylinder improve their ability to loosen and remove lint and other debris from the surface.

Figure 4:
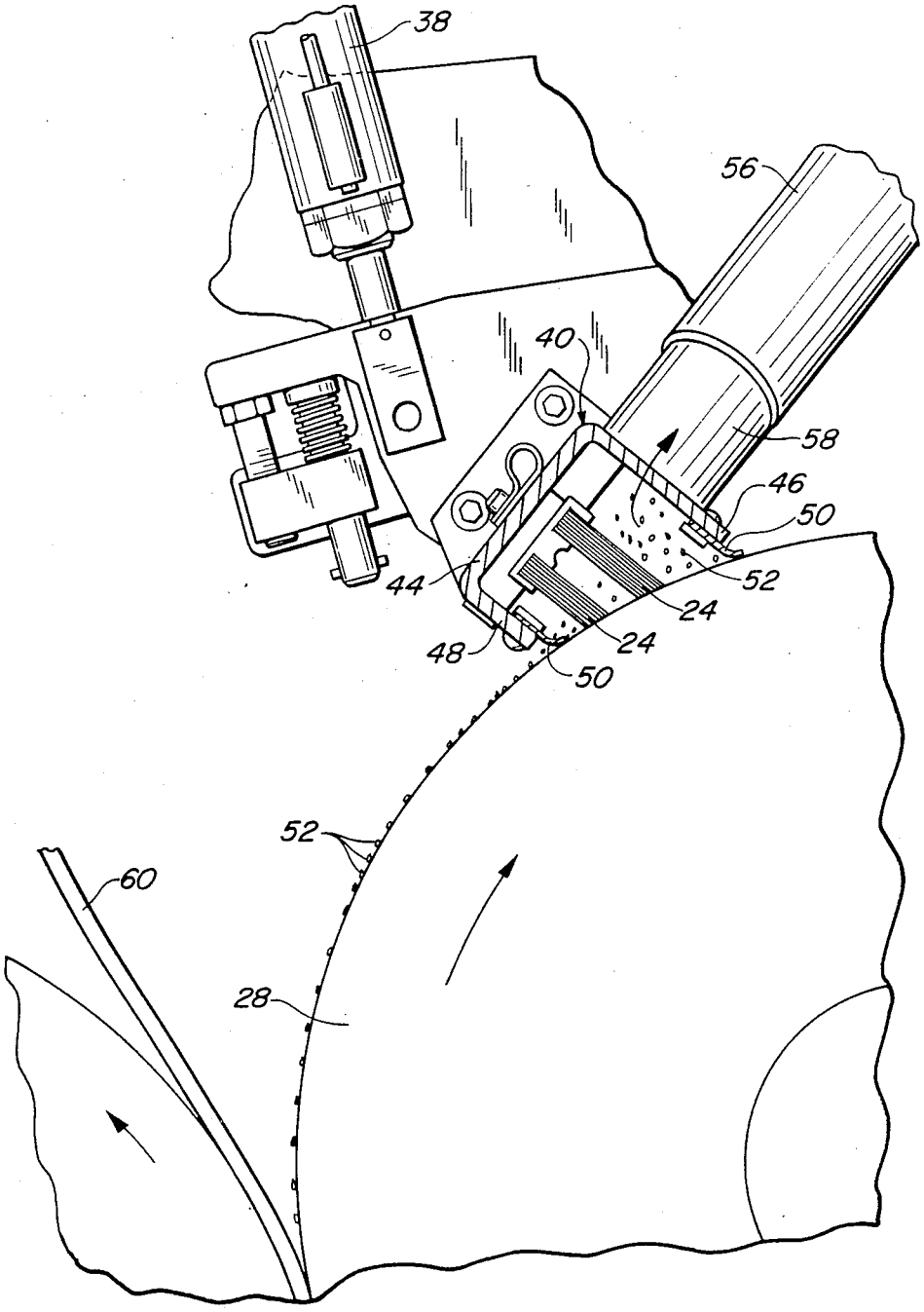
FIG. 4 is an enlarged side view in cross-section of the brush assembly.

Housing 40, in the form of an inverted U-shaped channel, has a top surface 44 and parallel sides, 46 and 48 respectively. Housing 40 is mounted between pivot arms 34 in a downward position with the open end facing the blanket cylinder 28. Alternatively, U-shaped channel 40 may be mounted forward or back relative to the centerline of the blanket cylinder 28 as desired. For example, FIG. 4 shows an embodiment wherein the brushes are mounted forward of the centerline of the blanket cylinder.

At least one brush 24 is mounted to the top surface 44 of housing 40 through the brush holder 25 and substantially parallel to sides 46 and 48 so that, when the cleaner is engaged, the brushes contact the surface of the blanket cylinder and loosen dirt and lint contained within the housing. Alternatively, a plurality of brushes may be positioned in rows on columns within the housing 40 for use in loosening lint and debris from the surface of the blanket cylinder 28.

Flexible wipers 50 are positioned at the ends of sides 46 and 48 of housing 40 and serve to contact the surface of blanket cylinder 28 to provide sealing surfaces in contact with the blanket roller when the blanket cleaner is engaged. These wipers 50 also serve a secondary purpose of loosening and dislodging lint and debris 52 from the surface of the blanket cylinder 28.

Loosened lint and debris 52 are removed from the interior of housing 40 by means of an appropriate vacuum system. A vacuum generating machine (not shown) is connected to vacuum port 58 in housing 40 by hose 56. Lint and debris 52 are conveyed through hose 56 by means of the vacuum to be deposited in an appropriate disposal unit (not shown).

Figure 2:
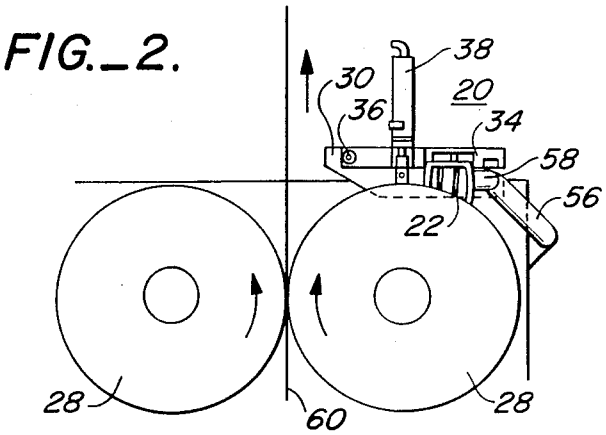
FIG. 2 is a side view of the vacuum blanket cleaner system in the engaged position.
Figure 3:
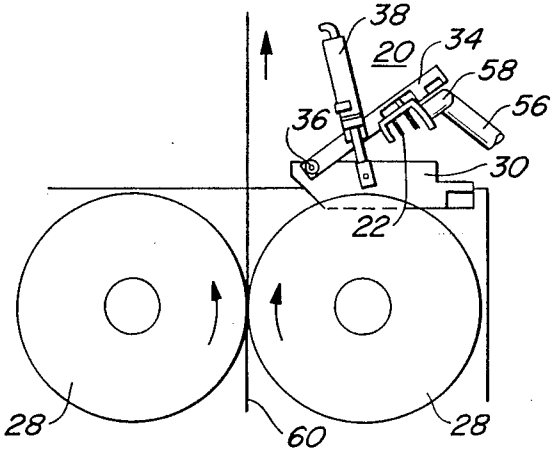
FIG. 3 is a side view of the vacuum blanket cleaner system in the disengaged position.

Referring now to FIGS. 2–4, there is shown the general operation of the blanket cleaner in accordance with a blanket to blanket press embodiment of the present invention. A web of imprinting material 60 passes between counterrotating blanket cylinders 28 and is imprinted on both front and rear sides of the web. In the course of this imprinting operation, lint and debris 52 from the web 60 accumulate on the surface of the blanket cylinders 28 and, if allowed to remain thereon, tend to reduce to overall quality of the printed product.

In order to remove this lint and debris from the surface of the blanket cylinders 28, blanket cleaners 20, generally located atop the blanket cylinders 28, are biased against the cylinders by biasing means in the form of actuators 38. Generally, it is not necessary that the blanket cleaners 20 be continuously in contact with blanket cylinders 28 throughout the imprinting operation, however, where an excessive amount of lint and debris accumulate rather quickly, it may be desirable to leave them engaged during operation of the press. Under normal operating conditions the blanket cleaners 20 are periodically actuated against the blanket cylinders for a predetermined time to effect cleaning of the surface.

Periodic operation of the blanket cleaner of this invention may be controlled by conventional timing mechanisms related either to rotation of the presses or on command of the operator. In any case, the operation of the actuator is controlled so that when blanket cleaning is desired, the actuator 38 is operated so that the cleaner is moved from the disengaged position (FIG. 3) to the engaged position (FIG. 2). In the engaged position the brushes 24 of the brush assembly 22 are brought into contact with the surface of blanket cylinder 28. The brushes 24 are utilized to wipe the blanket cylinder 28, and after a predetermined number of rotations, the actuator 38 is operated to cause the brush assembly 22 to disengage as shown in FIG. 3.

While engaged, lint and debris that is loosened and dislodged by the brushes 24, and to some degree, by the wipers is drawn off and disposed of by the vacuum system. This effectively removes the lint and debris from the blanket cylinder during the imprinting operation.

The particular embodiment just described is preferred because of the ease of installation and adjustment provided by the construction described. For example, the various working parts are located physically above the blanket cylinder 28, and thus are readily accessible both for installation and maintenance. Other locations are compatible with the broader aspect of our invention. However, it is clear that by utilizing the brush assembly 22 in conjunction with the vacuum means 56, the need for the lint catcher assembly used in the prior art is obviated.

Numerous variations, within the scope of the appended claims, will be apparent to those skilled in the art in light of the foregoing description and accompanying drawings. As indicated, other fluid operating sources or other timing mechanisms may be employed to alter the operation of the actuators disclosed. The sequence of the operating mechanism may be changed, if desired.

What is claimed is:

1. A dry mechanical vacuum system without the use of a liquid for removing dirt and lint from a blanket cylinder of an offset printing press having at least one blanket cylinder, said cleaning system comprising:

(a) a blanket cleaner mounting frame attached to a press frame adjacent the blanket cylinder;

(b) arm means movably connecting said mounting frame and said press frame;

(c) brush housing means attached to said movable arm means and adapted to extend along the length of the blanket cylinder;

(d) said housing means being adapted to enclose a portion of the surface of said blanket cylinder;

(e) means for moving said arm means to and from a first position away from said blanket cylinder and to and from a second position adjacent said blanket cylinder;

(f) brush means mounted within and enclosed by said housing means and adapted to engage said blanket cylinder when said brush means is in said second position;

(g) air flow means in cooperative relationship with said housing to establish a flow path within said housing at predetermined times whereby said brush means will loosen dirt and lint from said rotating blanket cylinder permitting said air flow means and housing to remove such dirt and lint;

(h) said housing means includes sealing means extending from said housing into contact with said blanket cylinder to provide a sealing surface between said blanket cylinder and said housing when said cleaner is in said second position adjacent said blanket cylinder;

(i) said brush means being adjustable relative to said housing means.

2. A dry mechanical vacuum system as in claim 1 wherein said brush means are segmented into sections, which sections are separably moveable between a first position away from said blanket cylinder and a second position adjacent said blanket cylinder.

3. A dry mechanical vacuum system as in claim 2 wherein said brushes are segmented into at least two sections.

4. The dry mechanical vacuum system of claim 3 wherein said brush means includes a pair of linear brushes removably mounted within said housing means.

5. The dry mechanical vacuum system of claim 3 wherein said moving means are operated pneumatically.

6. The dry mechanical vacuum system of claim 5 wherein said brush means comprises at least one linear brush.

7. In an offset printing press having a blanket cylinder adapted to rotate about a longitudinal axis, the improvement which comprises a dry mechanical blanket cleaner system without the use of a liquid for removing dirt and lint from the blanket cylinder during an uninterrupted course of a press run, said blanket cleaner system including brush means operatively mounted to said press, said brush means including at least one brush mounted for movement between at least a first position where said brush is in contact with said blanket cylinder and a second position where said brush is remote from said blanket cylinder, means for moving said brush between said first and said second positions; enclosure means surrounding said brush means and enclosing a portion of the blanket cylinder when the brush means is in contact with said blanket cylinder; means for adjusting said brush means relative to said enclosure means; air flow means communicating with said enclosure means and establishing a flow path within said enclosure means for removing dislodged debris from said blanket cylinder; sealing means depending from said enclosure means and engaging said blanket cylinder when said brush means is in contact with said blanket cylinder for substantially sealing off the flow path within said enclosure means.

8. In an offset printing press having a blanket cylinder adapted to rotate about a longitudinal axis, the improvement which comprises a dry mechanical blanket cleaner system without the use of a liquid for removing dirt and lint from the blanket cylinder during the uninterrupted course of a press run, said blanket cleaner system including brush means operatively mounted to said press, said brush means including at least one brush mounted for movement between at least a first position where said brush is in contact with said blanket cylinder and a second position where said brush is remote from said blanket cylinder, arm means for moving said brush between said first and said second positions; enclosure means surrounding said brush means and operatively movably mounted to said arm means for enclosing a portion of the blanket cylinder when the brush means is in contact with said blanket cylinder; means for adjusting said brush means relative to said enclosure means; vacuum means in cooperative relationship with said enclosure means and establishing a vacuum flow path within said enclosure means on one side of said brush means for automatically removing dislodged debris from said blanket cylinder; and sealing means depending from said enclosure means and engaging said blanket cylinder when said brush means is in contact with said blanket cylinder for substantially sealing off the flow path within said enclosure means.

9. A dry mechanical vacuum system without the use of a liquid for removing dirt and lint from a blanket cylinder of an offset printing press having at least one blanket cylinder, said cleaning system comprising:

(a) a blanket cleaner mounted frame attached to a press frame adjacent the blanket cylinder;

(b) arm means movably connecting said mounting frame and said press frame;

(c) brush housing means attached to said movable arm means and adapted to extend along the length of the blanket cylinder;

(d) said housing means being adapted to enclose a portion of the surface of said blanket cylinder;

(e) means for moving said arm means to and from a first position away from said blanket cylinder and to and from a second position adjacent said blanket cylinder;

(f) brush means mounted within and enclosed by said housing means and adapted to engage said blanket cylinder when said brush means is in said second position;

(g) air flow means in cooperative relationship with said housing to establish an enlarged flow path on one side of said brush means within said housing at predetermined times whereby said brush means will loosen dirt and lint from said rotating blanket cylinder permitting said air flow means and housing to remove such dirt and lint;

(h) said housing means includes sealing means extending from said housing into contact with said blanket cylinder to provide a sealing surface between said blanket cylinder and said housing when said cleaner is in said second position adjacent said blanket;

(i) said brush means being adjustable relative to said housing means.

10. In an offset printing press having a blanket cylinder adapted to rotate about a longitudinal axis, the improvement which comprises a dry mechanical blanket cleaner system without the use of a liquid for removing dirt and lint from the blanket cylinder during an uninterrupted course of a press run, said blanket cleaner system including brush means operatively mounted to said press, said brush means including at least one brush mounted for movement between at least a first position where said brush is in contact with said blanket cylinder and a second position where said brush is remote from said blanket cylinder, means for moving said brush between said first and said second positions; enclosure means surrounding said brush means and enclosing a portion of the blanket cylinder when the brush means is in contact with said blanket cylinder; means for adjusting said brush means relative to said enclosure means; air flow means communicating with said enclosure means and establishing a flow path on one side of said brush means within said enclosure means for removing dislodged debris from said blanket cylinder; sealing means depending from said enclosure means and engaging said blanket cylinder when said brush means is in contact with said blanket cylinder for substantially sealing off the flow path within said enclosure means.

11. An offset printing press, as defined in claim 10, wherein said brush means is spaced a greater distance from said enclosure means on one side of said brush means to provide an enlarged flow path for removing dislodged debris from said blanket cylinder.

* * * * *